United States Patent [19]

McKnight

[11] 4,023,702

[45] May 17, 1977

[54] PAINT TRAY HANDLE AND ROLLER SUPPORT

[76] Inventor: Virgil L. McKnight, 12307-2nd NE., Seattle, Wash. 98125

[22] Filed: June 14, 1976

[21] Appl. No.: 695,598

[52] U.S. Cl. ..... 220/94 R; 16/114 R; 16/126

[51] Int. Cl.[2] ..... B65D 25/28

[58] Field of Search ..... 220/94 R, 90, 96; 16/114 R, 114 A, 125, 126

[56] References Cited

UNITED STATES PATENTS

| | | | |
|---|---|---|---|
| 1,791,180 | 2/1931 | Wendle | 220/96 |
| 2,913,275 | 11/1959 | Rocca | 220/94 R X |
| 3,756,451 | 9/1973 | Popeil | 220/94 R X |

*Primary Examiner*—George E. Lowrance
*Assistant Examiner*—Steven M. Pollard

[57] ABSTRACT

A handle for use in conjunction with a standard paint tray, which, while not requiring any alteration to the paint tray, provides a stable, rigid support for the tray allowing it to be carried with one hand. The handle itself, once mounted on the tray, can be placed in two positions, the first, collapsed and adjacent the paint tray edge itself and therefore out of the way for loading the tray or the like and a second locked position for carrying the tray and further serving as a support for the handle of the roller when the painter needs both hands free for a short period.

3 Claims, 5 Drawing Figures

Fig. 3
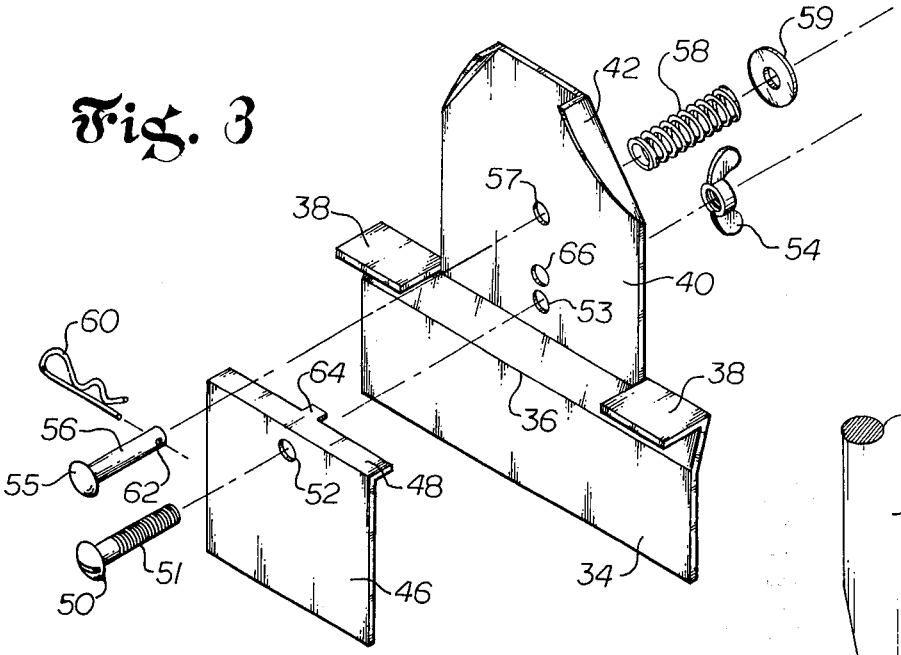
Fig. 5
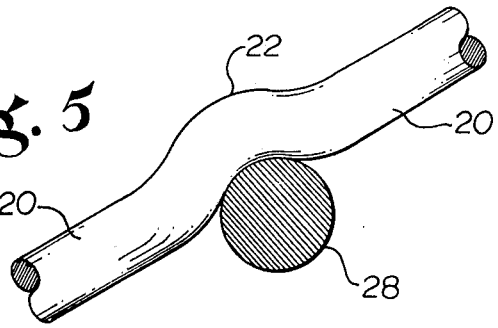
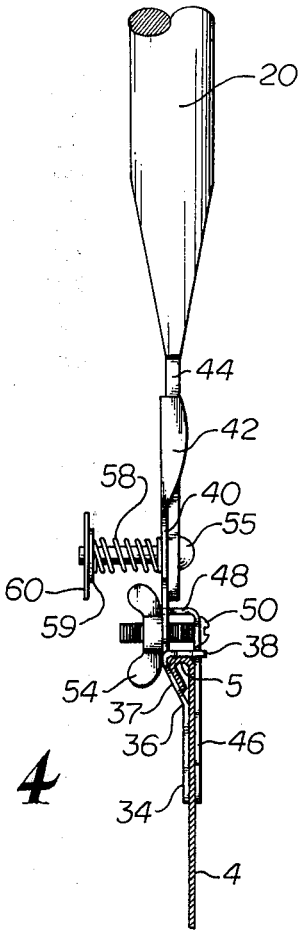
Fig. 4

PAINT TRAY HANDLE AND ROLLER SUPPORT

BACKGROUND OF THE INVENTION

Handles or bails for buckets or trays are well known and come in a great variety of configurations and utilize a large number of different means for securement. Structures and fastening methods typical of the prior art are disclosed in a number of references noted during the limited patentability search with respect to the present application.

U.S. Pat. No. 2,284,452 granted to Simons on May 26, 1942 shows a bent wire structure for supporting paint brushes above a can during cleaning thereof.

U.S. Pat. No. 2,659,096 granted Nov. 17, 1953 to Mencfeldowski discloses a strainer and cleaner for paint roller to be utilized in conjuction with a paint tray.

U.S. Pat. No. 2,698,450 granted to Mack on Jan. 4, 1955 discloses a paint tray which may be utilized in conjunction with a bucket and includes as an integral portion thereof a clamp means for holding the tray to the bucket as well as a handle means for carrying the two as a combination.

U.S. Pat. No. 2,950,012 granted Aug. 23, 1960 discloses an attachment for use with a paint tray, however, the attachment is secured to only one side of the tray and is used for support of various tools and probably not suitable for use as a handle.

U.S. Pat. No. 3,091,793 granted to Bentley on June 4, 1963 discloses a paint container device which is a modification of the well known commercial paint tray and has some advantages thereover.

U.S. Pat. No. 3,493,988 granted Feb. 10, 1970 to Tidwell likewise shows a modification of a roller paint bucket including a handle.

U.S. Pat. No. 3,590,416 granted July 6, 1971 to Henningsen discloses a paint tray and pail combination wherein the tray is secured to the top of the bucket and the bucket and tray combination is tipped to fill the tray with a liquid paint.

U.S. Pat. No. 3,641,616 granted to Bonci on Feb. 15, 1972 discloses a pair holder for utilization with a paint tray primarily for securement to the ladder. The device does in fact include a handle which could be used for carrying but is not readily adaptable to a commercial paint tray.

U.S. Pat. No. 3,731,840 granted to Beutler on May 8, 1973 discloses a series of handles to be used in conjunction with paint trays. Although these handles do greatly improve the convenience of using the tray itself they actually deal with a separate problem or do not solve the combination of problems as is done by the present invention.

U.S. Pat. No. 3,837,034 granted Sept. 24, 1974 to Leffert et al, discloses a paint tray and storage combination solving some of the problems addressed by the present invention.

U.S. Pat. No. 3,870,420 granted to Hawk discloses a means for storing a paint roller adjacent the paint tray without the necessity of leaving it in the paint but does not address itself to a means for carrying the tray.

With the above-noted prior art and problems in mind it is an object of the present invention to provide a unique handle for quick and easy attachment to a commercially available paint tray wherein the handle is rigidly secured to the tray thereby preventing an inadvertent tipping of the tray by the sloshing of the paint to one or the other end thereof.

Yet another object of the present invention is to provide a detachable handle for use upon a readily available paint tray wherein the handle, when in its locked upright position, serves as a support for the handle of the paint roller itself thereby freeing the painter's hands for other tasks.

Another object of the present invention is to provide a handle for a paint roller tray wherein the interconnection between the handle and the tray is of sufficient dimension extending along the side of the tray that it provides an adequate and rigid support for the tray thus preventing inadvertent tipping of the tray.

Still a further object of the present invention is to provide an attachment means for a paint tray, said attachment means being quickly and easily applied at approximately the center of the paint tray with respect to the weight and including a two positioned handle attachment, the first position being adjacent the edge of the paint tray and the second position being upright.

BRIEF DESCRIPTION OF THE DRAWINGS

FIG. 3 is an exploded view showing the various elements utilized in fabricating the attachment between the handle and the paint tray.

FIG. 4 is an elevational view further depicting the relationship between the paint tray, the attachment means and the handle means.

FIG. 5 is an enlarged view taken along the line 5—5 of FIG. 1 depicting the handle configuration.

DETAILED DESCRIPTION OF THE DRAWINGS

Figure 1:
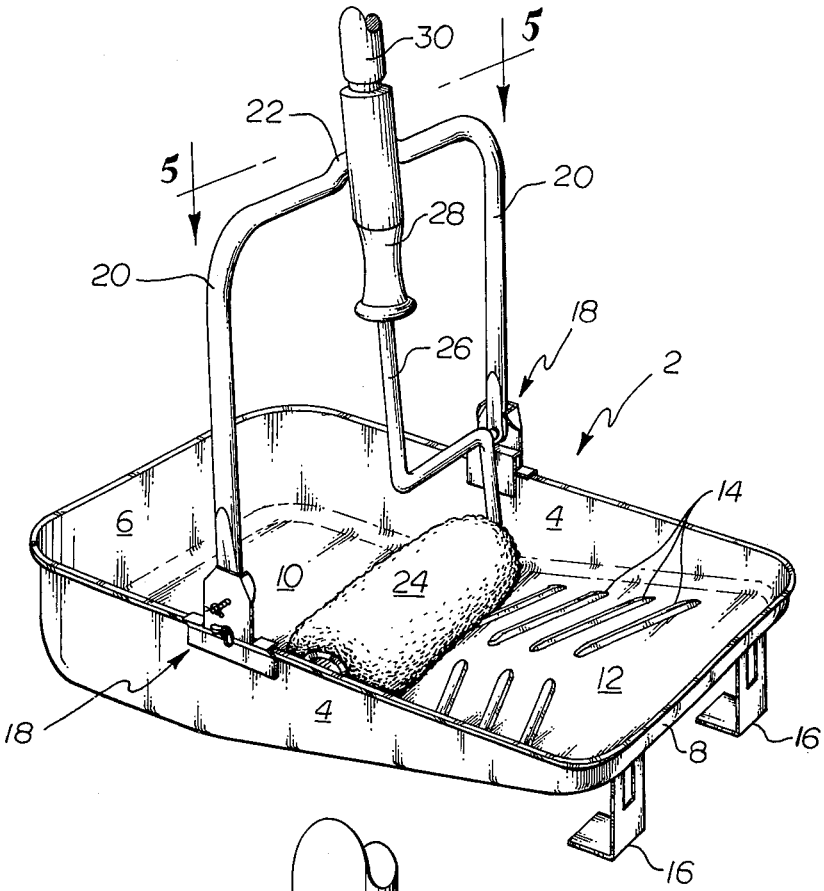
FIG. 1 is an isometric view of the inventive handle attached to a paint tray and including a roller resting thereagainst.

As seen in FIG. 1, the paint tray consists of the standard, commercially available pan-like element generally designated as 2 having vertically upwardly extending sides 4 and interconnecting rear upright vertical portion 6 and a front upright vertical portion 8. It is to be understood that the bottom of the pan is relatively flat at the back portion 10 and then slopes forwardly upward at 12 such that the forward lip has much less depth than the rearward interconnecting portion 6. The sloping portion would normally include a plurality of serations, ribs 14 or the like. In order to retain the pan in a level position while resting on a surface it includes a pair of legs 16 at the forward portion which are also formed to interact with a ladder step.

The handle attachment, as shown in general in this view, and as described in greater detail later includes an easily removable stable attachment means 18, an inverted U-shaped bail member 20 including a slight indentation or notch 22 to receive and support the handle of a paint roller as explained hereinafter. As seen in this view, the paint roller includes the roller itself 24, utilized in applying paint, attached to a rigid support member 26 shaped for convenience in using the roller and terminating in a handle member 28. It is to be understood that the handle member 28 normally includes the possibility of an extension member 30 being secured thereto for ladder free painting of ceilings or the like. As seen in this view, the handle member 20 when in its upright position, as shown, serves to support the handle of the paint roller when it is not in use whether or not it has the extension 30 attached thereto.

Figure 2:
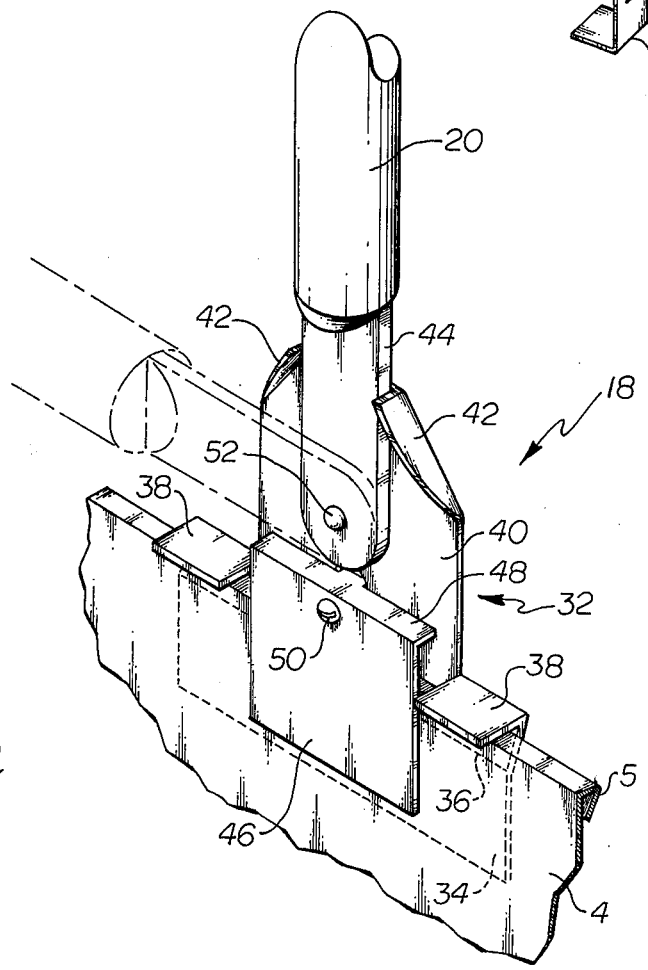
FIG. 2 is an enlarged view detailing the relationship between the edge of the paint tray and the attachment mechanism.

Referring now to FIG. 2, it can be seen that the sides 4 of the paint tray include an outwardly projecting bead 5. The attachment means, as seen in the views, includes a first element 32 having an external flat planer lower portion 34 which is bent rearwardly as at 36 to accommodate the bead 5 and then has the extremities bent inwardly as at 38 to contact the upper portion of the bead 5 forming a firm interconnection. The center portion of the element 32 extends vertically upwardly beyond the flat extensions 38 forming a handle supporting portion 40 having at its upper extreme a pair of upwardly bent handle securement or control elements 42. The upper portion 40 also includes a bore to receive a fastening member whereby the lower flattened portion 44 of handle 20 may be rotatably secured as described hereinafter.

The second main portion of the attachment member 18 is secured to the interior of the paint tray and is in general an inverted L-shaped configuration of fairly wide dimension such that the leg of the L 46 provides substantial contact with the interior of the tray and fits between the two ears 38. The upper portion of the element includes an outwardly projecting foot portion 48 which is abutted against the upwardly extending portion 40 of the first element 32. Tightening of the screw element 50 causes the flat leg portion 46 to be forced against the interior of the side of the paint tray 4 assuring positive contact between element 46, the lower portion 34 and slope 36 of element 32 and the side and lip of the paint tray. It is to be emphasized that the securing means is of sufficient dimensions that it provides substantial surface contact with the paint tray.

Referring now to FIG. 3, the handle attaching mechanism can be seen in greater detail. As is readily seen in this figure, the inverted L-shaped element which is secured to the interior portion of the paint tray also has a further outward projection or tab 64 approximately mid-way along the width of the foot 48 of the L. Tab 64 is adapted to pass through a hole 66 in vertical portion 40 of the outer element 32. The mechanical interrelationship between the tab 64 and the threaded fastener 50 having a shaft 51 passing through holes 52 and 53 and locked in position by wing nut 54 assures that the two elements 32 and 46 are held securedly together and locked to the edge of the paint tray in a fashion preventing relative movement therebetween.

The handle itself is secured in position by means of pin 56 having a smooth head 55, shank 56 and hole 62 to receive key 60. The shank of the pin passes through an appropriate hole within the handle and then through hole 57 in the outer element 32. A spring 58 and washer 59 are placed on the outer portion of the pin which is held securely in place by a cotter key 60 which passes through the hole 62. As is readily apparent, the utilization of the pin and a spring allows the handle element to flex adequately such that the handle can be moved from its upward locked position as shown in FIG. 1 to the horizontal position as shown in phantom in FIG. 2. The handle, when locked in its vertical position provides a rigid link between the hand of the carrier and the tray, preventing accidential tipping by the paint sloshing to one end.

The relative position of the various elements is further illustrated in FIG. 4 and it can be seen that the interior of the paint tray is relatively free of any protuberance that would inhibit or prohibit the utilization of the tray for its intended purposes and yet the handle and the bracket are of such a configuration and size that they provide an adequate and stable carrying device.

As noted hereinabove, with respect to FIG. 1 the upper portion of the handle 20 includes a bend or indentation 22 of such a size that the handle of the paint roller can be rested there against when not in use. The portion enlarged in FIG. 5 is a vertical view taken along line 5-5 of FIG. 1 and as can be seen the notch or indenture provides adequate stabilization for the paint roller handle whether or not it has an extension thereon, the notch being designed to accept the standard handle dimensions.

As can readily be seen, the present handle and attaching means provide a readily utilizable means for securing a handle to a paint tray without inhibiting the normal use of the tray. The handle is of such a configuration and is secured in such a manner that it allows the user to carry the tray in a stable fashion utilizing only one hand and further provides a rest for the handle of the roller when not in use.

What is claimed is:

1. A handle for a paint tray or the like, comprising:

a. first clamping means for placement upon the exterior of the opposite sides of the tray, said means including a lower portion for frictional contact with side of the tray, a pair of outwardly projecting ears for contact with the top edge of thetray and a portion projecting above the ears to support the handle, b. second clamping means for placement upon the interior of opposite sides of the tray cooperating with the first clamping means, said second clamping means including a lower portion for frictional contact with the tray and an upper portion for interaction with the first clamping means, and c. handle means secured to the second clamping means and extending from one side of the tray to the other spaced above the tray.

2. A handle as in claim 1 wherein the handle means includes an indentation to support the handle of a paint roller.

3. A handle as in claim 1 wherein the first clamping means includes means to lock the handle in the upright position.

* * * * *